US008500557B2

(12) United States Patent
Heim et al.

(10) Patent No.: US 8,500,557 B2
(45) Date of Patent: Aug. 6, 2013

(54) GAMING SYSTEM, APPARATUS AND METHOD OF PERFORMING A GAME

(76) Inventors: Wolfgang Heim, Brookwater (AU); Janis Margaret Heim, Brookwater (AU)

( * ) Notice: Subject to any disclaimer, the term of this patent is extended or adjusted under 35 U.S.C. 154(b) by 877 days.

(21) Appl. No.: 11/997,030

(22) PCT Filed: Aug. 11, 2006

(86) PCT No.: PCT/AU2006/001154

§ 371 (c)(1),
(2), (4) Date: Jun. 19, 2008

(87) PCT Pub. No.: WO2007/016751

PCT Pub. Date: Feb. 15, 2007

(65) Prior Publication Data

US 2008/0305875 A1 Dec. 11, 2008

(30) Foreign Application Priority Data

Aug. 11, 2005 (AU) ..... 2005904319

(51) Int. Cl.
*A63F 9/24* (2006.01)

(52) U.S. Cl.
USPC ..... 463/42

(58) Field of Classification Search
USPC ..... 463/16, 20, 42, 27, 34
See application file for complete search history.

(56) References Cited

U.S. PATENT DOCUMENTS 5,762,552 A * 6/1998 Vuong et al. ..... 463/25
5,830,067 A * 11/1998 Graves et al. ..... 463/40
5,855,515 A * 1/1999 Pease et al. ..... 463/27
6,113,495 A * 9/2000 Walker et al. ..... 463/42
6,280,325 B1 * 8/2001 Fisk ..... 463/19
6,443,840 B2 * 9/2002 Von Kohorn ..... 463/17
6,447,396 B1 * 9/2002 Galyean et al. ..... 463/40
6,508,709 B1 * 1/2003 Karmarkar ..... 463/42
6,616,143 B1 * 9/2003 Egner et al. ..... 273/430

(Continued)

FOREIGN PATENT DOCUMENTS

| | | | |
|---|---|---|---|
| EP | 0 673 004 | A2 | 9/1995 |
| WO | 02/13932 | A1 | 2/2002 |
| WO | 02/15995 | A1 | 2/2002 |
| WO | 2004/024266 | A1 | 3/2004 |

OTHER PUBLICATIONS

International Search Report.

*Primary Examiner* — Dmitry Suhol
*Assistant Examiner* — Jason Skaarup
(74) *Attorney, Agent, or Firm* — Howard & Howard Attorneys PLLC

(57) ABSTRACT

A game gaming system (10) comprises a gaming device (12) for at least part of a game at a first location (14) and an image capturing device (16) coupled to be in communication with a communications network (18) for capturing images of the gaming device. At least one output device (22) coupled to be in communication with the communications network is provided at one or more second locations (24) remote from the first location and a communication device (21) is provided at each of the first and one or more second locations. The at least one output device (22) displays the images of the gaming device enabling participants of the game at the one or more second locations to view the gaming device at the first location and at least one randomly selected participant participates in the game via the communication devices (21).

24 Claims, 4 Drawing Sheets

U.S. PATENT DOCUMENTS

| | | | | |
|---|---|---|---|---|
| 6,884,172 | B1 * | 4/2005 | Lloyd et al. | 463/42 |
| 6,955,604 | B1 * | 10/2005 | Graves et al. | 463/42 |
| 7,066,815 | B2 * | 6/2006 | Walker et al. | 463/23 |
| 7,244,180 | B2 * | 7/2007 | McHugh | 463/40 |
| 7,285,048 | B2 * | 10/2007 | Karmarkar | 463/42 |
| 8,123,618 | B2 * | 2/2012 | Karmarkar | 463/42 |
| 2002/0034980 | A1 * | 3/2002 | Lemmons et al. | 463/40 |
| 2002/0147047 | A1 | 10/2002 | Letovsky et al. | |
| 2003/0083132 | A1 * | 5/2003 | Berg et al. | 463/40 |
| 2003/0104853 | A1 * | 6/2003 | Tessmer et al. | 463/16 |
| 2003/0195043 | A1 * | 10/2003 | Shinners et al. | 463/42 |
| 2004/0097288 | A1 * | 5/2004 | Sloate et al. | 463/42 |
| 2005/0159212 | A1 | 7/2005 | Romney et al. | |
| 2006/0258446 | A1 * | 11/2006 | Nguyen et al. | 463/30 |
| 2008/0064471 | A1 * | 3/2008 | Bozeman | 463/17 |
| 2008/0102916 | A1 * | 5/2008 | Kovacs et al. | 463/16 |

* cited by examiner

10

GAMING SYSTEM, APPARATUS AND METHOD OF PERFORMING A GAME

FIELD OF THE INVENTION

The present invention relates to a gaming system, apparatus and method of performing a game.

BACKGROUND TO THE INVENTION

Establishments such as hotels, bars, public houses, clubs and the like often run games and competitions in addition to their core services to increase custom and revenue. Typically, patrons of an establishment purchase one or more entries to a competition, usually in the form of a ticket or similar, the ticket having a unique identifier, such as a unique number, for that particular competition. Alternatively, the ticket(s) may be given to patrons upon the purchase of one or more specific products or upon spending over a threshold amount of money. At some point after sales of the tickets have ceased, a draw or other form of random selection process takes place in which one of the ticket numbers from a pool of ticket numbers is selected. The patron who purchased the ticket having the same number as the randomly selected number wins the competition and typically wins a prize or entry into a subsequent competition, such as a grand draw or the like.

Whilst such competitions boost revenue for the establishment and provide entertainment for the patrons, the increase in revenue is limited by the number of patrons in the establishment during the period in which the tickets are sold.

One attempt to address this problem is to repeat the competition throughout the day and/or night. However, this has only met with limited success because of, for example, the capacity limitation of the establishment and the diminishing appeal of the competition over time to patrons repeatedly exposed to the same competition, for example, in one night.

Attempts at increasing the revenue obtained from gaming and gambling have included conveying the games being played to a wider audience. For example, US 2002/0147047 discloses a system and method to enable people to gamble from remote locations. The system includes a video camera that relays images of a live game, such as roulette or black jack, to remote locations to enable people at the remote locations to participate in the game by placing bets on the game being played. The system is also capable of playing archived footage of previously played games at the remote locations. A similar system is also disclosed in US 2005/0159212.

Although these systems and methods communicate games to a wider audience, including beyond the confines of the casino or similar establishment, and therefore are likely to increase revenue, they do not encourage players to attend the venue(s) and the players have no interaction with patrons of the venue(s).

Similar systems are also disclosed in EP673004 and WO 02/13932. EP673004 employs the closed circuit television system of an establishment, such as a hotel, to relay images of a gaming area to the hotel rooms. Although this system enables patrons to participate in the games from the comfort of their hotel rooms, a person has to be staying at the hotel to take advantage of this system. Another disadvantage of this system is that whilst the patron is playing the game, the central computer disconnects the telephone line in the hotel room. This system therefore disables another potential revenues stream for the hotel because the patron is unable to, for example, make outside calls or order room service via the hotel room phone whilst using the system.

WO 02/15995 discloses an interactive game system in which games are broadcast via television networks and utilise participants' set top boxes and televisions. In one embodiment of the invention, the set top boxes comprise video cameras and a microphone to capture images and sound of the participant, which are transmitted to a server system. Participants are thus able to view the other participants of the game and, for example, a game show host. Whilst this system provides a suitable method of interactive game play, it does not encourage people to visit an establishment nor does it have the potential to increase the revenue of the establishment. Furthermore, only those with suitable equipment can participate.

Hence, there is a need for a method, system and/or apparatus that addresses or at least ameliorates one or more of the aforementioned problems of the prior art or provides a useful commercial alternative.

In this specification, the terms "comprises", "comprising" or similar terms are intended to mean a non-exclusive inclusion, such that a method, system or apparatus that comprises a list of elements does not include those elements solely, but may well include other elements not listed.

SUMMARY OF THE INVENTION

In one form, although it need not be the only or indeed the broadest form, the invention resides in a gaming system comprising:

a gaming device for at least part of a game at a first location;

an image capturing device for capturing images of the gaming device, said image capturing device coupled to be in communication with a communications network;

at least one output device at one or more second locations remote from said first location, said at least one output device coupled to be in communication with said communications network; and a communication device at each of said first location and said one or more second locations;

wherein said at least one output device displays the images of the gaming device enabling participants of said game at said one or more second locations to view said gaming device at the first location and wherein at least one of said participants selected by a random selection process participates in said game via said communication devices.

The gaming system may be a board comprising a plurality of face-down playing cards from which a pre-selected card identity must be selected to win. Alternatively, the gaming device is an electronic game generator.

Suitably, the image capturing device is one of the following: a USB camera, a parallel port camera, a Windows compatible capture device, a network IP camera, a digital video camera, a mobile telephone camera, a personal digital assistant camera, a camera comprising a SIM card.

Suitably, the at least one output device is one of the following: a television; a LCD screen, a plasma screen, a projector and screen/wall, a PC monitor, a thin client, a mini projector and screen/wall, said mini projector coupled to be in communication with the communication device.

Suitably, the communication device at each of said locations is one of the following: a mobile telephone, a personal digital assistant, a soft phone, a video phone, a telephone, a keypad, a touch sensitive screen.

The gaming system may further comprise an image capturing device at one or more of said second locations, said image capturing device(s) coupled to be in communication with the communications network.

Suitably, images of the one or more second locations captured by the image capturing device(s) at the one or more second locations are transmitted to the other locations via the communications network.

The gaming system may further comprise a duplication of the gaming device at each of the second locations.

Suitably, the gaming system further comprises at least one output device at the first location.

The gaming system may further comprise a microphone and/or a scanner at one or more of said locations coupled to be in communication with the communications network.

The gaming system preferably comprises a processor at the first location and/or at the one or more second locations coupled to be in communication with the image capturing device and the communications network.

In another form, although again not necessarily the broadest form, the invention resides in a method of performing a game via a gaming system, said method including the steps of:

distributing game entries in association with a first location and in association with one or more second locations, said one or more second locations being remote from the first location;

capturing images of a gaming device for at least part of a game at the first location via an image capturing device, said image capturing device coupled to be in communication with a communications network;

transmitting said images of the gaming device to the one or more second locations via said communications network;

displaying said images of the gaming device via at least one output device to participants of said game at said one or more second locations, said output device coupled to be in communication with said communications network; and randomly selecting at least one of said participants to participate in said game via communication devices at said first location and at said one or more second locations.

Suitably, distributing the game entries includes one or more of the following: selling the game entries; providing the game entries to a purchaser of a predetermined product or service; providing the game entries to a purchaser who spends a threshold amount of money.

Suitably, displaying images of the gaming device includes projecting images of the gaming device from one of the communication devices onto a screen or wall.

The step of randomly selecting at least one of said participants may include randomly selecting one of the locations to be a winning location.

The method may further include randomly selecting a game entry associated with the winning location to be the winning game entry.

The method may further include duplicating events associated with the gaming device at the first location at a duplication of the gaming device at the one or more second locations.

The method may include changing the location of the gaming device periodically or intermittently.

Suitably, the method may include displaying advertising and/or entertainment content on the at least one output device at the first location and/or the one or more second locations. The content can be selected according to the location at which the content is being displayed.

The method may further include scanning the game entries prior to randomly selecting at least one of said participants to participate in said game and suitably, only scanned game entries are eligible for the game to ensure that the randomly selected participant is present at one of the locations.

In a further form, although again not necessarily the broadest form, the invention resides in a portable gaming apparatus comprising:

a gaming device;

an image capturing device for capturing images of the gaming device;

a communication device coupled to be in communication with the image capturing device for relaying images of the gaming device to one or more communication devices at locations remote from that of the gaming device via a communications network.

The portable gaming apparatus preferably further comprises a processor coupled to be in communication with the communication device. The processor may be coupled to be in communication with an output device.

Further features of the present invention will become apparent from the following detailed description.

BRIEF DESCRIPTION OF THE DRAWINGS

By way of example only, preferred embodiments of the invention will be described more fully hereinafter with reference to the accompanying drawings, wherein.

DETAILED DESCRIPTION OF THE INVENTION

Figure 1:
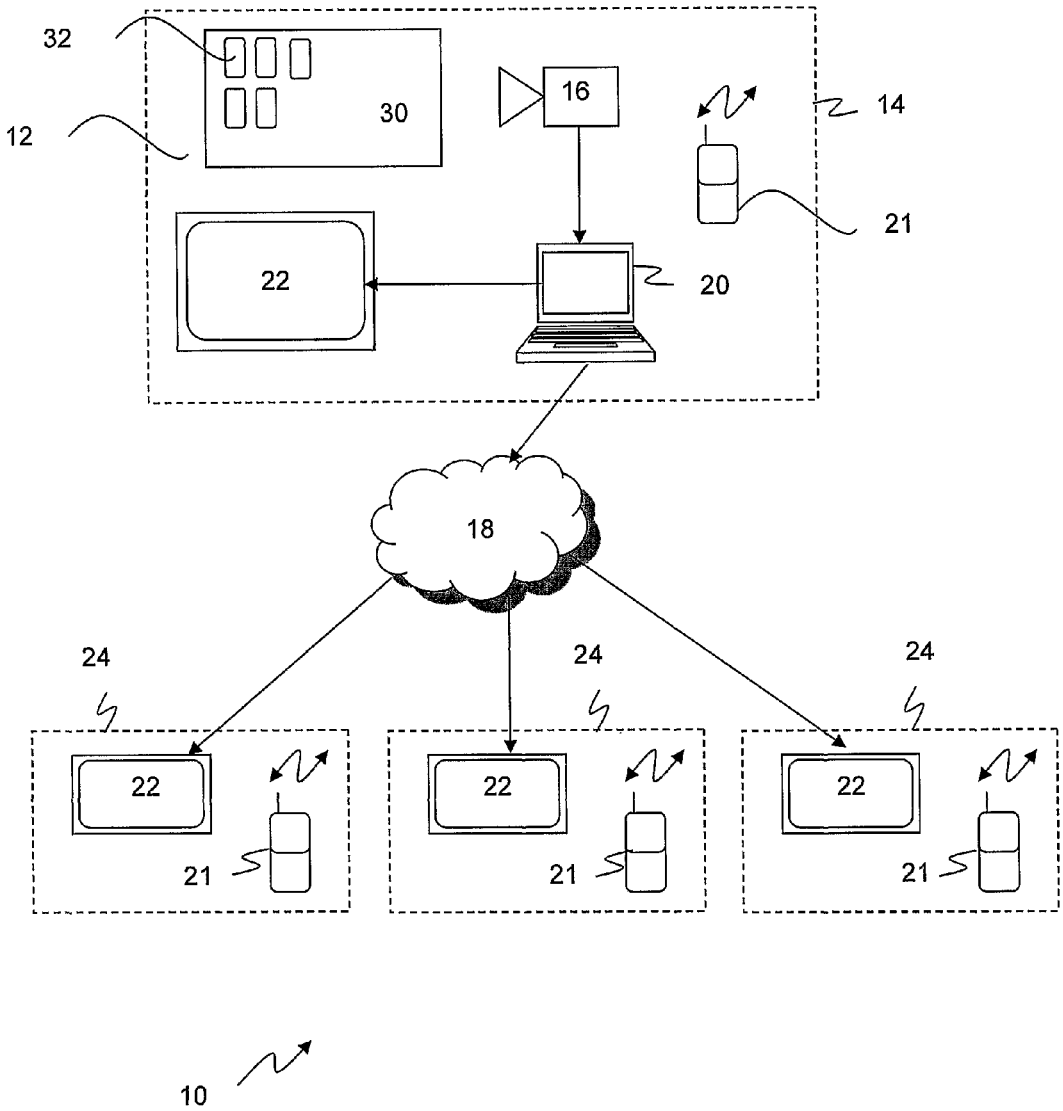
FIG. 1 is a schematic representation of a gaming system according to an embodiment of the present invention.

Referring to FIG. 1, there is provided a gaming system 10 comprising a gaming device 12 for or related to a game at a first location 14, which may be any establishment where a game can be conducted. In one embodiment, the first location 14 is a bar, hotel, public house, club or the like. However, in other embodiments, the first location 14 could be an office or other establishment dedicated to the gaming system 10. An image capturing device 16 is provided for capturing images of the gaming device 12. In one embodiment, the image capturing device 16 is coupled to be in communication with a communications network 18 via processor 20, such as a computer. In this embodiment, the image capturing device 16 may be, for example, a USB or parallel port camera, a Windows compatible capture device, a network IP camera, a digital video camera or a camera in a portable electronic device, such as a mobile telephone or personal digital assistant (PDA). The processor 20 may comprise, for example, an Intel Pentium 1000 MHz processor or higher running operating systems such as Microsoft Windows 95 or subsequent versions/editions or UNIX or LINUX utilizing open source products and having access to 128 MB RAM and 1 GB hard disk space. The communications network may be the Internet or a wide area network (WAN) or the like with broadband transmission capability over the communications network 18. Communications network 18 can also comprise a wireless and/or landline telecommunications network.

The system 10 also comprises communication devices 21 at both the first location 14 and one or more second locations 24 remote from the first location 14. In one embodiment, communication devices 21 are mobile telephones, PDAs with mobile telecommunication capabilities or other such enabled portable electronic device communicating over a mobile telephone network, which can be the communications network 18. Alternatively, communication devices 21 are standard landline telephones communicating over the Public Switched Telephone Network (PSTN). In another embodiment, communication devices 21 are so-called soft phones using Voice over Internet Protocol (VoIP). However, this embodiment would require a processor, such as a computer, at the second location 24. In the embodiment comprising soft phones for the communication devices 21, processor 20 at the first location 14 would be utilized. In a preferred embodiment, the communication devices 21 are video phones.

The system 10 further comprises at least one output device 22 at the one or more second locations 24 and the at least one output device 22 is coupled to be in communication with the communications network 18. In one embodiment, a single output device 22 is provided in the, or each, second location 24. In another embodiment, multiple output devices 22 are provided in various locations, such as in different rooms, of each second location 24. It will be appreciated that in other embodiments, multiple output devices 22 may be provided in some of the second locations 24 and only a single output device 22 provided in other second locations 24. The output devices 22 may be, for example, a standard television (CRT), a plasma screen, a projector and screen/wall or a LCD screen. The output device 22 can also be a thin client, a PC monitor or one of the aforementioned output devices coupled to a PC to display the images received from the first location via the internet utilizing broadband technology and routers. This allows for live video streaming, video on demand and live webcasts. This also facilitates complete logging and archiving of all published media. Combinations of such output devices may be provided at the second locations 24. The at least one output device 22 displays the at least one image of the gaming device 12 captured by the image capturing device 16 thus enabling a participant of the game at one or more of the second locations 24 to view the gaming device 12 at the first location 14 and participate in the game via the communication devices 21.

One or more output devices 22 may also be provided at the first location 14. For example, in a larger establishment, the game may be hosted in one room, but participants of the game, e.g. those having bought tickets to enter the game, may be in other rooms of the same establishment and unable to see directly the hosted game being played. Output devices 22 in the other rooms of the same establishment at the first location 14 enable participants in the same establishment to view the game without requiring them to be in the same room.

The method of the present invention will now be described with reference to the flowchart in FIG. 2 in the context of a raffle type game incorporating a subsequent game participated in by a winner of the raffle type game.

Figure 2:
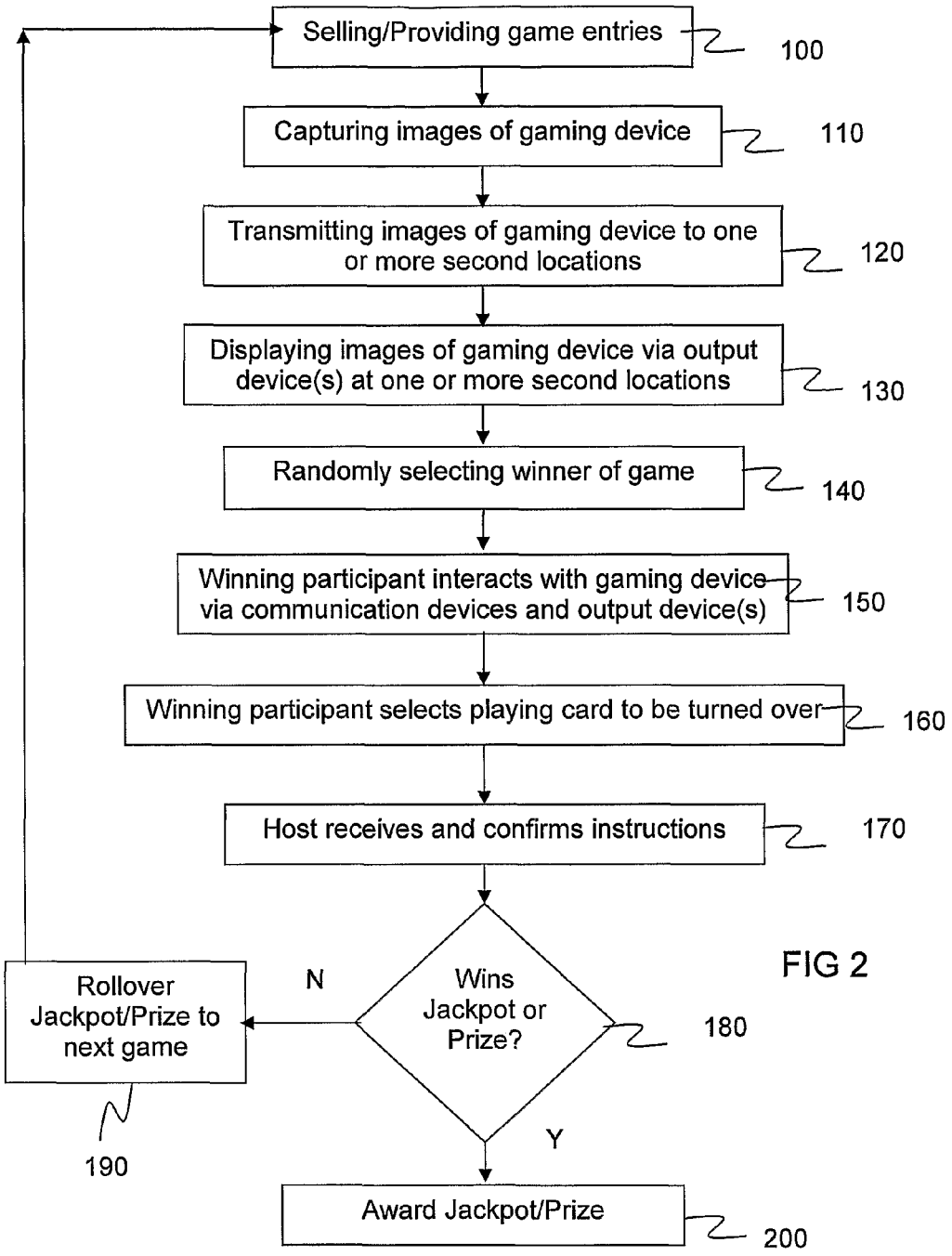
FIG. 2 is a flowchart of a method of performing a game over the gaming system shown in FIG. 1 according to an embodiment of the present invention.

Referring to step 100 in FIG. 2, the method includes distributing game entries at, or in association with, the first location 14 and at, or in association with, or for, one or more second locations 24. Distribution of the game entries can be via sales. In another embodiment, instead of, or in addition to, selling game entries, game entries may be provided to customers when making a purchase of one or more particular items, such as a particular brand of drink and/or a particular meal or when spending over a threshold amount of money. Game entries can also be sold, or otherwise distributed to customers from outlets associated with the establishment, such as a bottle shop. According to one embodiment, game entries may be sold and/or distributed at any time the establishment is open prior to the game commencing. Alternatively, game entries may be sold and/or distributed at designated times, such as on designated days and/or nights or at specific times, such as from 6 pm to 9 pm on one or more nights of the week, to encourage customers/participants to be at particular establishments at certain periods. It is also envisaged that game entries could be sold by establishments other than those at the first location and the second locations, but authorized to sell or otherwise distribute game entries. Examples of such establishments include, but are not limited to, news agencies, retail outlets, shopping centres, gyms etc, The game entries may be raffle tickets or similar comprising unique numbers for the particular game. Batches of unique numbers could be allocated for different locations. For example, numbers 1-100 may be allocated to the first location 14, numbers 101-200 to one of the second locations 24, numbers 201-300 to another of the second locations 24 and so on. Such allocations could be varied over time as the game is run, such as each night or each week, so the same numbers are not always allocated to the same location and to accommodate participants' superstitions for "lucky" numbers. In an alternative embodiment, the raffle tickets or the like may also be coloured or colour-coded so numbers can be repeated at different locations, but a unique winner can still be selected and identified. Where numbers are repeated for any one draw, for example at different locations, another draw can be made to determine the winning location.

Referring to step 110, the method includes capturing images of the gaming device 12 at the first location 14 via the image capturing device 16. In step 120, the method includes transmitting the images of the gaming device 12 to the one or more second locations 24 via the communications network 18 and displaying the images of the gaming device 12 via at least one output device 22 at the one or more second locations 24, as represented by step 130.

In step 140, the method includes randomly selecting, at the first location 14, a winner of the game from the game entries. In one embodiment, this is carried out using a random number generator as is known in the art. For example, the random number generator could be mechanical or electronic. According to one embodiment, the selection at the first location 14 of the winner determines the participant to be involved in a subsequent game involving the gaming device 12. However, the winning participant does not have to be present in the first location 14 and may be present in any one of the second locations 24. Alternatively, the purpose of the random selection at the first location can be to select a winning location rather than a ticket number and a winning individual. Another random selection process can then take place at the winning location to determine the winning individual.

Referring to step 150, the winning participant interacts with the gaming device 12. Where the winning participant is in one of the second locations 24 or in another part of the first location 14, the winning participant participates in the game involving the gaming device 12 via communication devices 21 and output device 22.

With reference to FIG. 1, in one embodiment, gaming device 12 comprises a board 30 with a deck of playing cards 32 affixed face down thereto by any suitable means. The winning participant can view the gaming device 12 via the output device 22 if they are not present in the same room or location as the gaming device 12. With reference to step 160, via the communication devices 21, the winning participant selects one of the playing cards 32 to be turned over. This may be done by identifying a row number and a column number. A host of the game at the first location 14 receives and confirms the instructions via the communications device 21, as represented by step 170, before turning over the selected playing card. The method may also include recording the instructions of the winning participant to help resolve any subsequent dispute over the instructions provided. The winning participant can view the playing card being turned over via the output device 22. With reference to steps 180 and 200, if the selected playing card is the card previously identified or advertised to participants as the winning playing card, e.g. the ace of spades or a joker is the pre-selected identity of the winning card, the participant wins a prize, such as a jackpot pool of money. If the participant is a winner, contact details of the participant, the winning amount and other details, such as the winning location and the winning number that enabled them to play the final game, are recorded in the system 10, such as via one of the processors 20, to ensure the correct participant is subsequently paid the correct amount and for auditing purposes. With reference to step 190, if the participant does not select the winning playing card, the jackpot may be rolled over to the next scheduled game, which may be later the same day/night or at the same time the following day or week.

It will be appreciated that the present invention is not limited to the particular type of game played at the first location 14 and relayed to the second locations 24 via image capturing device 16, processor 20, communications network 18 and output devices 22 and a wide range of games or competitions are within the scope of the present invention. For example, in an alternative embodiment, instead of the board 30 with a deck of playing cards 32 affixed thereto, gaming device 12 comprises a device in the style of a slot-machine or "pokie" comprising reels having symbols thereon. The device 12 may be set in motion by the host at the first location and when the reels come to rest, if the symbols on the reels align, the participant wins, for example, the jackpot. In a preferred form of this embodiment, money would not need to be inserted into the slot-machine type device to set it in motion. In a further alternative embodiment, gaming device 12 comprises a dart board via which, for example, a minimum number of points must be scored to win the jackpot. Another alternative is a rotating wheel that must stop at a particular segment for the jackpot/prize to be won.

The gaming device 12 may be realized in the form of a physical device, such as the board 30 and playing cards 32 or in electronic format, for example, represented electronically on a screen and created by an electronic game generator. For example, Microsoft® PowerPoint® could be used or another suitable application comprising graphics animation. Alternatively, the gaming device may be realized as a combination of the two, such as a physical slot machine in which the reels are displayed electronically on a screen.

The suspense of the game may be heightened and more revenue generated in the first and second locations 14, 24 by revealing the winning number in stages. For example, the winning number may be a three-digit number and in one embodiment, once the winning number has been randomly selected, each digit could be revealed at time intervals, such as hourly.

Figure 3:
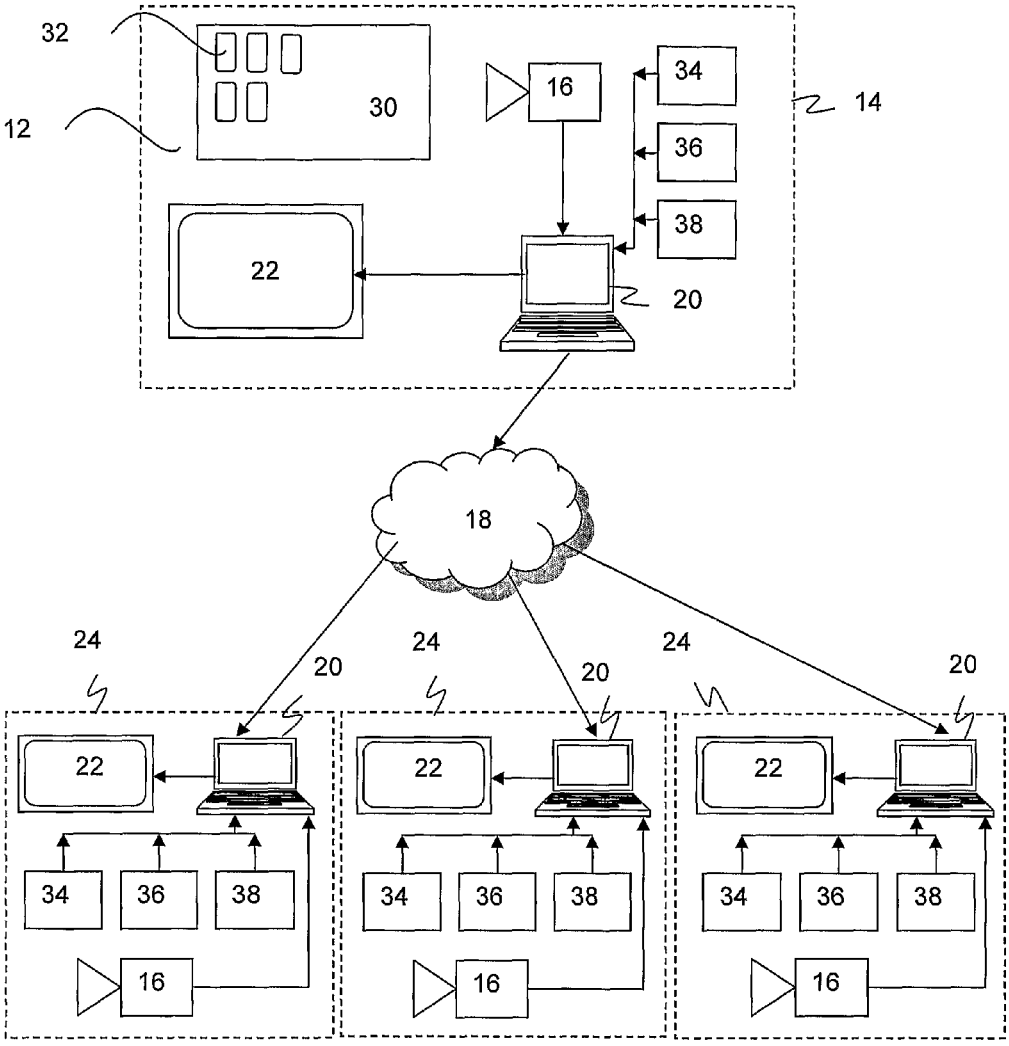
FIG. 3 is a schematic representation of a gaming system according to an alternative embodiment of the present invention.

With reference to FIG. 3, in an alternative embodiment, the game entries, such as tickets, comprise a readable identifier, such as a barcode, which can be read by a scanner 34 provided at the first location 14 and the second locations 24, the scanner 34 being coupled to be in communication with processor 20 at each location. The system 10 registers when a game entry has been sold or issued at a location by, for example, scanning the game entry with the scanner 34. According to one embodiment, for the game entry to be valid for the game being played, the game entry must be re-scanned by the scanner 34, for example, on the night the game is being played. Therefore, if a customer purchases, or is issued, a game entry prior to the game commencing, such as a few days before, the customer must still be present at one of the locations 14, 24 when the game is being played for the game entry to be eligible for the draw. In the absence of the game entry being re-scanned, the game entry will not be eligible and its unique identifier will be removed from the pool of game entry identifiers that could be selected by the random number generator.

In an alternative embodiment, the communication device 21 is in the form of a keypad, touchpad, touch sensitive screen or the like 36 coupled to be in communication with processor 20 at each location 14, 24. The communication device 21 in the form of a keypad or the like 36 enables the winner of the game to electronically select or nominate one of the playing cards 32. For example, each of the playing cards 32 may be numbered on the reverse and the winner may select a number via the communication device 21 so that the playing card the winner wishes to select and have turned over is unambiguously identified. Identification of the selected card may be highlighted by, for example, selective illumination.

In a further embodiment, a microphone 38 is provided at the locations 14, 24 coupled to be in communication with the processor 20. The audio signal is transmitted via the communications network 18 to each of the locations, for example, using VoIP, to enable the winner to be heard.

According to another embodiment, image capturing devices 16 coupled to be in communication with the processor 20 are provided at each of the second locations 24 to capture images of the participants, and in particular the winner of the draw, at their particular location. The image of the winner interacting with the gaming device 12, such as making their playing card selection, is transmitted to each location and displayed on the output device 22. According to one embodiment, the display of the output device 22 may be split electronically such that one portion of the output device 22 displays an image of the gaming device 12 and another portion of the output device 22 displays an image of the winner, for example discovering they have won and making their selection.

It is envisaged that, in one embodiment, to maintain the integrity of the game being played, the gaming device 12 is kept in a secured container such as a locked transparent case or cage, such that the gaming device 12 can be viewed, but not tampered with. The secured container may be locked with at least two locks. One lock may be opened by the host establishment and another of the locks may be opened by an independent security organization or auditing body, such as a gaming authority.

Depending on the method(s) employed to run the game, the monetary amount that can be won may be limited by the licensing laws or regulations in place in the relevant jurisdiction. This may result in different maximum prizes being available in different locations 14, 24 in different jurisdictions that are part of the same game. The licensing laws or regulations are also likely to have other impacts such as preventing personnel employed by or working for the establishments at the first and second locations from participating in the game.

It is envisaged that multiple draws may take place, for example, in one night so that the timing of draws can be tailored for different venues to take into account, for example, variations in attendances, different time zones or the like.

In a further alternative embodiment, the game may be web hosted such that the random selection of the winner takes place at a location of, for example, a server, which may be the first location 14. In this case, the gaming device 12 will be realized in electronic format and the winner of the draw will interact with the gaming device as described above. In this case, the gaming device 12 at the first location 14 is coupled to be in communication with the communications network 18 and the one or more image capture devices 16 at the second locations 24 are coupled to be in communication with the communications network 18, the image capturing devices for capturing images of participants of the game in the second locations. The output devices 22 display images provided by the gaming device 12 enabling participants of the game at the second locations 24 to view the images. The communication devices 36, 38 enable at least one participant to participate in the game and the image capture devices 16 enable participants at the second locations to view the participant participating in the game.

Figure 4:
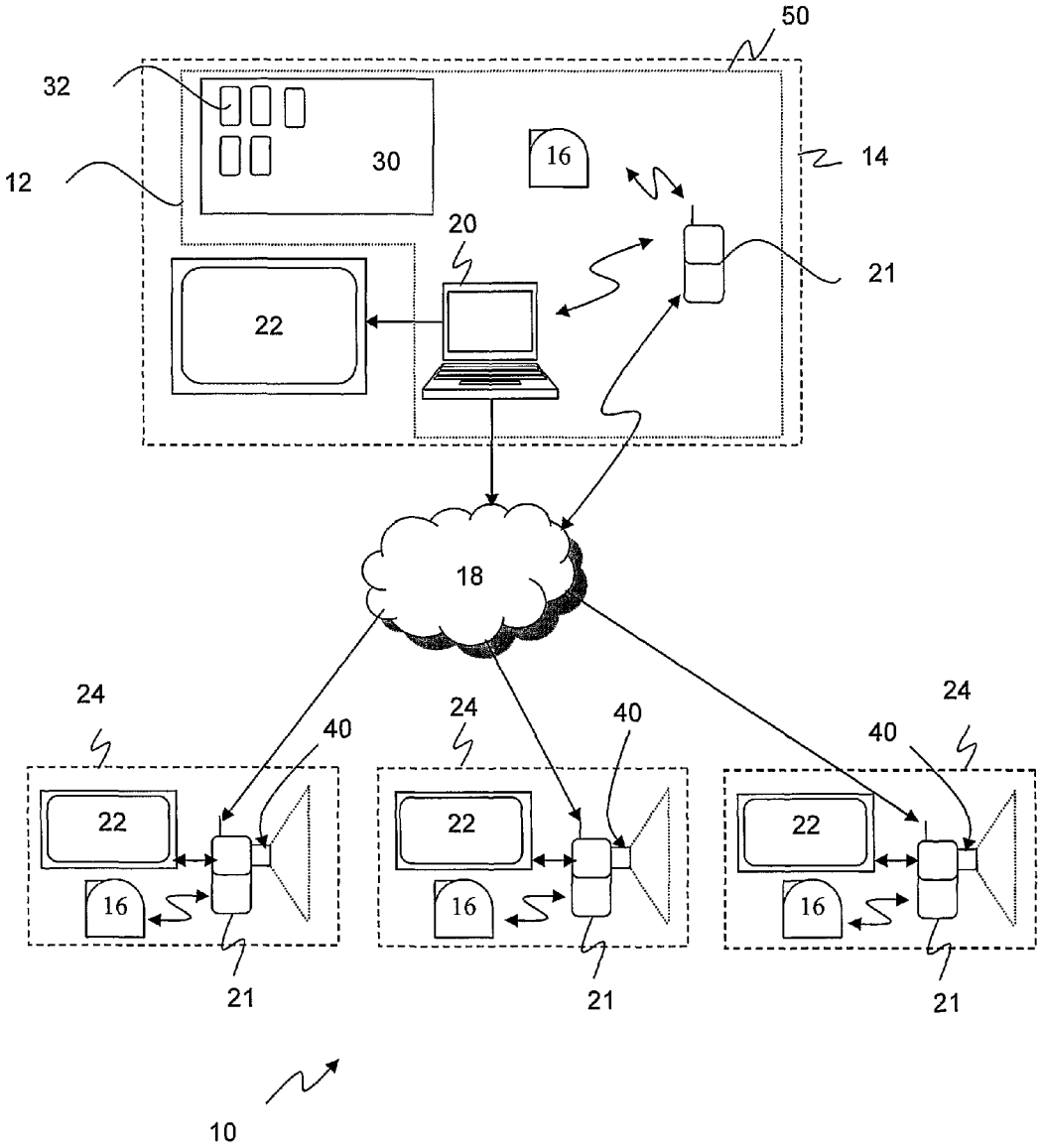
FIG. 4 is a schematic representation of a gaming system according to a further alternative embodiment of the present invention.

With reference to FIG. 4, according to another embodiment of the present invention, the image capturing device 16 for capturing images of the gaming device 12 at one of the locations 14, 24 is in the form of a camera that relays images of the gaming device 12 to communication devices 21 at the other locations. In this embodiment, the image capturing device 16 comprises a subscriber identity module (SIM) card providing the image capturing device 16 with its own dedicated phone number. However, the image capturing device 16 does not store or otherwise record the images and instead relays the images to communication devices 21 in the form of mobile telephones or other portable communication devices, such as PDAs, that are registered with the image capturing device 16. Such an image capturing device is available from the mobile phone company Three (3) under the name EyeCam.

In this embodiment, images of the gaming device 12 are relayed from location 14 to mobile telephones 21 at each of the other locations 24. The mobile telephone 21 at each location comprises a mini projector 40, which is either built into the mobile telephone, in the form of an adaptor connected thereto, or otherwise coupled to be in communication with therewith. Examples of such projectors are available from Light Blue Optics Limited, Cambridge, England, Upstream Engineering Oy, Oulu, Finland and Project-a-Phone, Inc., Massachusetts, USA. The mini projector 40 transmits the images from the image capturing device 16 in a magnified form onto a screen or blank wall to enable patrons at the other locations to view the gaming device 12. In another variation, the mobile telephone 21 can be coupled to one or more output devices 22 at the other locations to display the images of the gaming device 12. This embodiment can also comprise processor 20, which can receive the images of the gaming device 12 from the communication device 21 at the first location 14 and relay them via the communications network 18 to the second locations 24.

A feature of the present invention that is applicable to one or more embodiments described herein is that the physical location of the gaming device 12 can change periodically or intermittently. For example, the gaming device 12 can be at one location one week and another location the next and, if desired, cycle through the locations that are part of the system of the present invention. This adds to the potential for the system of the present invention to increase revenue for the establishments at each location because there will be a certain amount of hype and anticipation associated with the gaming device 12 being present at a location.

In yet another embodiment, the gaming device 12 can be duplicated at each of the locations that are part of the system. As the game is played via the gaming device 12 at the host location 14, the gaming device 12 at the other locations 24 can be updated accordingly.

With reference to FIG. 1, to achieve the portable nature of the system, another aspect of the present invention is a portable gaming apparatus 50, which comprises the gaming device 12 and an image capturing device 16 for capturing images of the gaming device 12. The apparatus 50 comprises communication device 21 coupled to be in communication with the image capturing device 16 for relaying images of the gaming device 12 to one or more communication devices 21 at locations remote from that of the portable gaming apparatus 50 via the wireless communications network 18. Apparatus 50 can also comprise processor 20 in which case images of the gaming device 12 can be transmitted to the other locations 24 via the internet or other communications network.

In any embodiment of the present invention, processor 20 can relay content, such as advertising content and entertainment content or the like to the output devices 22 at the locations 14, 24. Such content can be played before, during and/or after the game has been played. Although some or all of the content can be common to more than one location, the content can be tailored to the location at which it is being output such that different content is displayed at different locations. For example, processor 20 of the system may display advertisements for particular businesses at locations which the owners, customers and potential customers of the businesses frequent. Such businesses may also be businesses that sell or otherwise distribute game entries. Such advertising can also promote the products and/or services offered by the establishment at the particular location. The content can include a countdown until the game is played and can include audio, such as music, geared to the game being played and/or geared to the time remaining until the game is played to build the atmosphere surrounding the game.

Hence, the method and system of the present invention thus provides a solution to the aforementioned prior art problems of limited revenue raising from games and competitions and waning interest in such games and competitions by virtue of relaying images of the gaming device 12 in the first location 14 to one or more second locations 24 via the image capturing device 16, processor 20, communications network 18 and output devices 22. Therefore, the revenue is not limited by the size of or the number of patrons in, a single establishment because the patrons of many other establishments distributed, potentially, over a large geographical area can also participate in the same game. Where image capturing devices 16 and output devices 22 are provided at each location 14, 24 all participants at all locations can see the identity of the winner and their location and can view the winner's selection via the gaming device 12. In addition to sharing the entertainment with a broader audience, participants can verify someone has won the draw and whether the jackpot has been won or whether it rolls over to another occasion, thus maintaining customer loyalty. There is also likely to be heightened enthusiasm for participation in the game caused by friendly rivalry between neighbouring establishments and the anticipation associated with learning the winner of the jackpot. Further interest in the game is likely to be caused by the increased prize pool that will be possible due to a larger number of tickets/game entries being sold in multiple establishments in multiple locations. This will be compounded where the jackpot is not won and is rolled over to the next occasion. The advertising and entertainment content aspect of the present invention also contribute to increasing revenue for each establishment and encourages customer loyalty.

Throughout the specification the aim has been to describe the invention without limiting the invention to any one embodiment or specific collection of features. Persons skilled in the relevant art may realize variations from the specific embodiments that will nonetheless fall within the scope of the invention.

The invention claimed is:

1. A gaming system comprising:

a first gaming device positioned at a first location for generating at least part of an outcome of a game and displaying the game outcome at the first location;

a first image capturing device positioned at the first location, the first image capturing device including a camera orientated with respect to the first gaming device for capturing images of the first gaming device displaying the game outcome and at least a portion of an area of the first location, said image capturing device coupled to be in communication with a communications network;

an output device positioned at the first location and at one or more second locations remote from said first location, said output devices coupled to be in communication with said communications network;

a second image capturing device positioned at one or more of said second locations coupled to be in communication with the communications network, each second image capturing device including a camera orientated within the second location for capturing images of the one or more second locations, said images of the one or more second locations transmitted to the output devices located at one or more of said first location and said second locations via the communications network;

a second gaming device positioned at one or more of the second locations, each second gaming device for duplicating the displayed game outcome of the first gaming device at the first location and each second gaming device updated as the game is played via the first gaming device at the first location; and a communication device at each of said first location and said one or more second locations;

wherein at least one participant of the game at the first or second locations is selected by a random selection process to participate in said game via said communication devices, and wherein each of said output devices displays the images of the first gaming device located at the first location, the images of the second locations, and an image of the at least one selected participant enabling participants of said game at each location to view said first gaming device at the first location, the images of the second locations, and the image of the at least one selected participant.

2. The gaming system as claimed in claim 1, wherein said first gaming device is a board comprising a plurality of face-down playing cards from which a pre-selected card identity must be selected to win.

3. The gaming system as claimed in claim 1, further comprising an electronic duplication of said first gaming device displayed on said output devices at said first location and said second locations, said electronic duplication generated by an electronic game generator.

4. The gaming system as claimed in claim 1, wherein the image capturing device is one of the following: a USB camera, a parallel port camera, a Windows compatible capture device, a network IP camera, a digital video camera, a mobile telephone camera, a personal digital assistant camera and a camera comprising a SIM card.

5. The gaming system as claimed in claim 1, wherein the at least one output device is one of the following: a television; a LCD screen, a plasma screen, a projector and screen or wall, a PC monitor, a thin client and a mini projector and screen or wall, said mini projector coupled to be in communication with the communication device.

6. The gaming system as claimed in claim 1, wherein the communication device at each of said locations is one of the following: a mobile telephone, a personal digital assistant, a soft phone, a video phone, a telephone, a keypad and a touch sensitive screen.

7. The gaming system as claimed in claim 1, further comprising a microphone at the first location and at one or more of said second locations, said microphones coupled to be in communication with the communications network.

8. The gaming system as claimed in claim 1, further comprising a scanner at the first location and at one or more of said second locations, said scanners coupled to be in communication with the communications network.

9. The gaming system as claimed in claim 1, further comprising a processor at the first location coupled to be in communication with the image capturing device and the communications network.

10. The gaming system as claimed in claim 1, further comprising a processor at the one or more second locations coupled to be in communication with the communications network.

11. The gaming system as claimed in claim 1, further comprising:

a portable gaming apparatus comprising:

the first gaming device;

the first image capturing device for capturing images of the first gaming device; and a communication device coupled to be in communication with the first image capturing device for relaying images of the first gaming device to one or more communication devices at one or more of the first locations and the one or more second locations via the communications network.

12. The gaming system as claimed in claim 11, wherein the portable gaming apparatus further comprises a processor coupled to be in communication with the communication device and an output device.

13. The gaming system as claimed in claim 1, further comprising a processor for distributing game entries in association with the first location and in association with one or more second locations, and for randomly selecting at least one of the participants to participate in the game via the communication devices at the first location and at one or more second locations.

14. A method of performing a game via a gaming system, said method including the steps of:

distributing game entries in association with a first location and in association with one or more second locations, said one or more second locations being remote from the first location;

generating a game with a first gaming device, the first gaming device positioned at a first location for displaying a game outcome at the first location;

capturing images of the first gaming device for at least part of a game at the first location and images of the first location via first image capturing device positioned at the first location, the first image capturing device including a camera orientated with respect to the first gaming device for capturing the images of the first gaming device displaying the game outcome, the first image capturing device coupled to be in communication with a communications network;

transmitting said images of the first gaming device and the first location to the one or more second locations via said communications network;

duplicating events associated with the at least part of the game of the first gaming device at the first location on a second gaming device at the one or more second locations and updating each second gaming device as the game is played via the first gaming device at the first location;

capturing images of said one or more second locations via a second image capturing device coupled to be in communication with a communications network, each second image capturing device including a camera orientated within the second location for capturing images of the one or more second locations;

transmitting the images of the one or more second locations to one or more of the first location and the second locations via the communications network;

randomly selecting at least one participant to participate in the game based on the game entries via communication devices at the first location and at one or more of the second locations; and displaying to participants of the game the images of the first gaming device at the first location, the images of the second locations and an image of the at least one randomly selected participant via an output device at each first and second location, the output devices coupled to be in communication with the communications network.

15. The method as claimed in claim 14, wherein distributing the game entries includes one or more of the following: selling the game entries; providing the game entries to a purchaser of a predetermined product or service; and providing the game entries to a purchaser who spends a threshold amount of money.

16. The method as claimed in claim 14, wherein displaying images of the first gaming device includes projecting images of the first gaming device from one of the communication devices onto a screen or wall.

17. The method as claimed in claim 14, wherein the step of randomly selecting at least one of the participants includes randomly selecting one of the locations to be a winning location.

18. The method as claimed in claim 17, further including randomly selecting one of the game entries associated with the winning location to be a winning game entry.

19. The method as claimed in claim 14, further including changing the location of the gaming device periodically or intermittently.

20. The method as claimed in claim 14, further including displaying advertising and entertainment content on the at least one output device at one or more of the first location and the one or more second locations.

21. The method as claimed in claim 14, further including selecting the content according to the first location or the one or more second locations at which the content is being displayed.

22. The method as claimed in claim 14, further including scanning the game entries prior to randomly selecting at least one of said participants to participate in the game.

23. The method as claimed in claim 22, wherein only scanned game entries are eligible for the game to ensure that the randomly selected participant is present at one of the locations.

24. The method as claimed in claim 14, wherein each of the gaming entries is associated with an unique identifier, and wherein the random selection of the at least one participant is based on random selecting the unique identifier associated with one of the game entries.

* * * * *